United States Patent [19]

Cook et al.

[11] Patent Number: 4,676,656

[45] Date of Patent: Jun. 30, 1987

[54] FLUID HANDLING APPARATUS AND METHOD

[75] Inventors: Robert D. Cook, Los Altos; Donald M. Besemer, Los Altos Hills, both of Calif.

[73] Assignee: Syntex (U.S.A.) Inc., Palo Alto, Calif.

[21] Appl. No.: 694,713

[22] Filed: Jan. 25, 1985

[51] Int. Cl.[4] ..... B01F 15/00

[52] U.S. Cl. ..... 366/142; 73/863.91; 53/525; 53/559; 366/348

[58] Field of Search ..... 366/348, 349, 69, 76, 366/139, 140, 142, 143, 150, 208, 218, 219, 271, 275; 422/99, 100; 73/864.11, 863.31, 863.32, 863.91; 414/676; 141/67; 53/559, 525

[56] References Cited

U.S. PATENT DOCUMENTS

| | | | |
|---|---|---|---|
| 2,561,339 | 7/1951 | Chediak | 23/253 |
| 3,313,240 | 4/1967 | Bentov | 366/275 |
| 3,353,325 | 11/1967 | Jensen | 53/559 |
| 3,526,480 | 9/1970 | Findl et al. | 23/253 |
| 3,607,090 | 9/1971 | Maxon | 23/253 R |
| 3,650,698 | 3/1972 | Adler | 23/253 R |
| 3,675,488 | 7/1972 | Viktora et al. | 73/421 R |
| 3,712,591 | 1/1973 | Booth | 366/275 |
| 3,854,703 | 12/1974 | Gibbs et al. | 259/11 |
| 3,944,188 | 3/1976 | Parker et al. | 259/54 |
| 3,999,949 | 12/1976 | Andersson et al. | 23/259 |
| 4,231,989 | 11/1980 | Thoma | 422/63 |
| 4,264,560 | 4/1981 | Natelson | 422/58 |
| 4,265,544 | 5/1981 | Banno et al. | 356/427 |
| 4,363,782 | 12/1982 | Yamashita | 422/65 |
| 4,366,663 | 1/1983 | Grebe | 53/559 |
| 4,390,499 | 6/1983 | Curtis et al. | 422/72 |
| 4,395,493 | 7/1983 | Zahniser et al. | 435/289 |

FOREIGN PATENT DOCUMENTS

| | | | |
|---|---|---|---|
| 189079 | 4/1964 | Sweden | 366/275 |

*Primary Examiner*—Robert W. Jenkins
*Attorney, Agent, or Firm*—John A. Dhuey

[57] ABSTRACT

A fluid handling system is described wherein a small fluid volume is placed on a reversibly-deformable support, which can be deformed to form a cavity. As the fluid clings to the surface of the support, it is physically agitated and mixed as the support is deformed. The deformable support can be utilized to provide fluid containers of varying sizes, to accommodate different fluid volumes and as a transport mechanism to move fluid from one location to another.

30 Claims, 6 Drawing Figures

FLUID HANDLING APPARATUS AND METHOD

BACKGROUND OF THE INVENTION

1. Field of the Invention

The present invention relates to methods and apparatus for handling small fluid volumes. (As used herein and throughout the description and claims directed to this invention, the term "fluid" encompasses liquids alone and liquids containing particulate matter of whatever kind but excludes gases.) In particular, the invention relates to an apparatus and method which are utilized to mix small fluid volumes by applying a deformation force to a deformable support for the fluid and causing agitation and mixing of the fluid as it clings to the support during deformation.

The apparatus and method of the present invention have particular application to situations where small sample volumes are utilized and processed. One such example is the clinical laboratory, in which chemical analyzers are used with fluid samples which are added to reagents and mixed in discrete reaction cups. These reaction cups are typically molded plastic about the size and shape of a sewing thimble. Sometimes they are of a special shape to include multiple compartments, viewing windows for optics, or shaped for centrifugation. They are usually loaded by hand into some form of automated mechanism although automatic loaders have been built. Complicated mechanisms have been built to move the cups between different locations so that various operations can be performed as required by the analysis method. At the end of the analysis, they must be carefully removed to prvent spilling of materials which may constitute a biohazard. The volumes of the cups are usually quite large, consisting of hundreds of microliters. Mixing of sample and reagents can be done in several ways: employment of centrifugal forces, turbulence due to hydraulic discharge, magnetic stir bars or mixing blades or paddles which require cleaning between successive samples. Discrete plastic cups have moderately thick walls and have poor thermal conductivity, making rapid temperature equilibration difficult even with waterbaths. Additionally, discrete cups can be relatively expensive costing from one to several cents each.

As will be seen more fully from the description of the invention which follows, the present invention affords a fluid handling system which minimizes, obviates or totally overcomes problems presented by the prior art devices. For example, it is possible to handle very small volumes of fluid, even sample volumes below 50 microliters. The apparatus promotes mixing of the fluid sample within itself or, if mixed with a reagent, without using any external mixer which is in contact with the reaction mixture. Additionally, the system yields an apparatus which promotes good thermal conductivity such that temperature gradients throughout the mixed system are minimized. The system additionally exhibits simple and safe disposal of used materials and facilitates lower costs through the use of disposables and reduced labor costs or machine costs due to the absence of discrete reaction cups.

2. State of the Art

Numerous devices and apparatus have been suggested for fluid handling of relatively small fluid volumes. Those apparatus and methods have utilized various mechanisms for transporting and mixing the fluids. For example, U.S. Pat. No. 3,650,698 described the dispensing of fluid samples and/or reagents onto a film strip containing quantities or spots of dried suspension of reaction intensifying agent, which may contain magnetic particles to promote mixing when subjected to an alternating magnetic field. U.S. Pat. No. 3,854,703 describes a system in which a jet of gas is directed onto a fluid volume resting on a support to cause relative movement between the fluid and the support, thus promoting mixing of the fluid. U.S. Pat. No. 4,265,544 describes a rotary solenoid coupled to a shaft and sample holder to reciprocally move the sample holder and thus promote mixing of the fluid contained therein. U.S. Pat. No. 4,390,499 describes a test package adapted for use with a spinning rotor to increase mixing which includes a sample compartment, and integral cuvette and compartments for prepackaged reagents. The reagents are adapted to be introduced via breakable seals into the sample compartment which contains the sample to be analyzed. The sample and reagents are introduced via another breakable seal into a cuvette. There the mixture is agitated by mechanical means such as a rotating bar or a pulsating diaphragm.

SUMMARY OF THE INVENTION

The present invention relates to a method of reducing fluid parameter gradients, such as material gradients or temperature gradients, throughout a fluid volume which comprises placing a portion of a fluid volume on a deformable support and deforming the support. In one aspect of the invention, the deformable support is reversibly-deformable and the mixing of the fluid portion is caused by the alternate application and release of the deformation force applied to the support. The magnitude of the deformation force can be varied either discontinuously or continuously depending on the particular application.

The invention is also directed to apparatus for containing and/or mixing small fluid volumes. In one aspect, the apparatus comprises a reversibly-deformable support for receiving a fluid sample, means for dispensing a portion of the fluid onto the reversibly-deformable support and means for applying a force to deform the support and cause mixing of the fluid portion on the support. In another aspect, the apparatus comprises a liquid-impervious, flexible sheet, a substantially rigid support for the sheet which defines a well having a selected contour adjacent the sheet and means for reversibly conforming the sheet to the selected contour of the well. Wells of various sizes can be utilized in the apparatus to define fluid containers having varying sample volumes and means can be supplied for moving the sheet relative to the support, thus transporting fluid volumes to various locations in the fluid handling system in which the apparatus of the present invention is utilized.

DETAILED DESCRIPTION OF THE INVENTION

Figure 1:
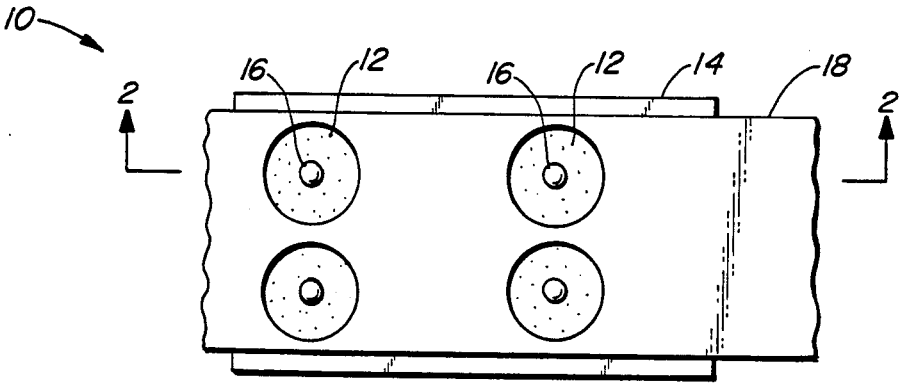
FIG. 1 is a top view of an embodiment of the present invention.
Figure 2A:
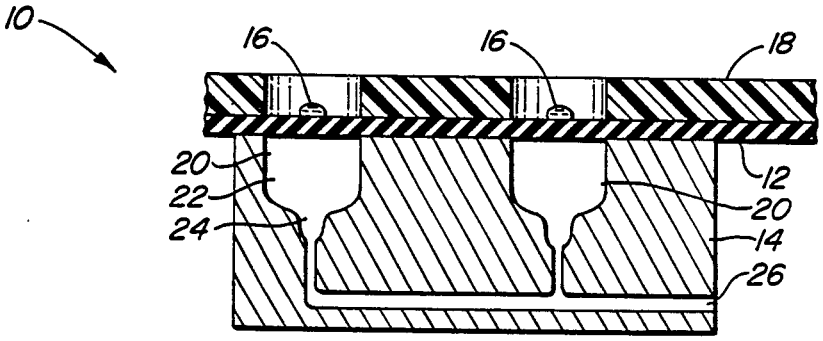
FIG. 2A is a side view, in section, of the apparatus of FIG. 1 along line 2—2, at a first point in time.
Figure 2B:
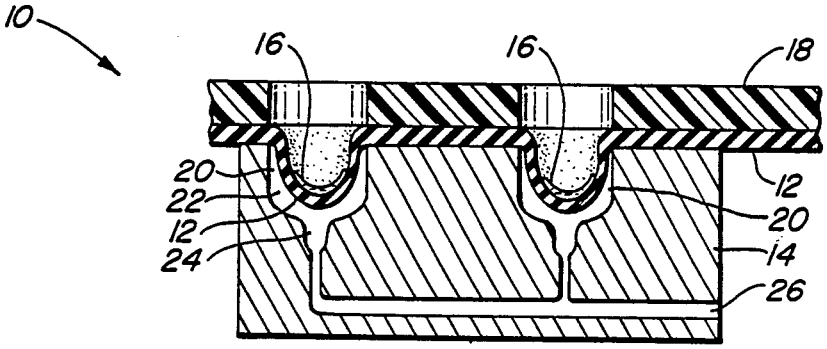
FIG. 2B is a side view, in section, of the apparatus of FIG. 1 along line 2—2 at a second point in time, illustrating container formation.

With initial reference to FIGS. 1 and 2, a particular embodiment of the present invention is illustrated which comprises a fluid handling apparatus generally designated 10 which includes a first support for a fluid sample such as sheet 12. Sheet 12 is reversibly-deformable and generally liquid imprevious. It can be manufactured conveniently from a thin elastomeric film. Thicknesses of approximately 0.002 to 0.04 inches have been found suitable, with a thickness of approximately 0.004–0.006 inches being presently preferred when the sheet is made from latex or from silicone rubber. The exact thickness employed will depend on the strength of the material chosen and may also depend on the material's thermal conductivity and the particular application. An important characteristic is that sheet 12 not rupture under the deformation forces typically applied to it as described below since the fluid volume is directly applied to and supported by sheet 12. Alternatively, the first support can be provided as a flexible strip or tape which may be wound into a roll, or provided as a cassette, for ease in dispensing.

Sheet 12 is supported on a substantially rigid support 14 which defines at least one well 20. Well 20 can be present either singly or as a plurality of units, and may be of the same size or of differing sizes. A typical total volume for a single well is on the order of 250–2500 microliters in diagnostic applications, but may differ for other applications. Additionally, each well 20 may include various sections or compartments such as illustrated by first compartment 22 and a second compartment 24, which define differing contours within a single well 20 and also create, in conjunction with sheet 12, fluid containers or receptacles of varying size.

In order to promote mixing of the fluid volume or to form a fluid receptacle from sheet 12, support 14 and well 20, it is necessary to apply a deformation force to sheet 12. One convenient means is illustrated in FIG. 2, but other means which accomplish similar results could be used as well. As illustrated in FIG. 2, the bottom portion of well 20 is connected to a vacuum source (not shown) for applying a deformation force to sheet 12. Typically, the vacuum source is connected via a conduit 26 to the bottom of well 20. It is clear that although FIG. 2 illustrates each well 20 being served by the same conduit 26, each well could be served separately by its own vacuum source or various combinations of wells 20 can be interconnected for any particular application. Accordingly, it is contemplated that in certain applications, certain portions of sheet 12 may be made to conform to the contours of some of wells 20, while at the same time other portions of sheet 12 may be free of the application of a deformation force over other of wells 20 and thus remain in a flat configuration.

Sheet 12 can include a semi-rigid or rigid portion 18, which is adapted to facilitate transport of sheet 12 relative to support 14, but yet expose limited areas of sheet 12. The exposed areas of sheet 12 are adapted to receive portions of fluid samples 16 which can be transported and positioned over wells 20. When the fluid sample 16 is present on sheet 12 and positioned over a well 20, the vacuum source can be actuated to reduce the pressure within well 20, thus creating a pressure differential across the sheet and deforming sheet 12. As can be seen most clearly in FIG. 2B, actuation of the vacuum source reduces the pressure beneath sheet 12 and causes it to deform and extend into and conform to the contour of wells 20. By varying the magnitude of the vacuum (i.e. the deformation force) the interfacial area between the fluid sample 16 and sheet 12 is also varied and physical agitation and mixing of the fluid is caused to occur.

Physical mixing not only reduces material concentration gradients throughout the fluid but additionally promotes thermal equilibration because of the mixing of the fluid and the contact of sheet 12 with the walls of support 14. Support 14 can be provided with conventional temperature controls, such as water channels or electric heaters, to afford and maintain the fluid volumes at a particular, desired temperature. By eliminating any air space between sheet 12 and support 14 and by minimizing the thickness of sheet 12, within structural limitations, very efficient heat transfer between support 14 and fluid sample 16 occurs. Thus, rapid thermal equilibration can be achieved within the fluid sample which is necessary for the accuracy of many chemical analyses. The stretching of sheet 12 over the surface contour of well 20 causes the thickness of sheet 12 to decrease and increases the rate of heat transfer between the fluid sample 16 and support 14. The magnitude of the pressure can be modulated with time as desired for a particular application to vary the elongation of sheet 12 within wells 20 to provide a thorough mixing action.

Figure 4:
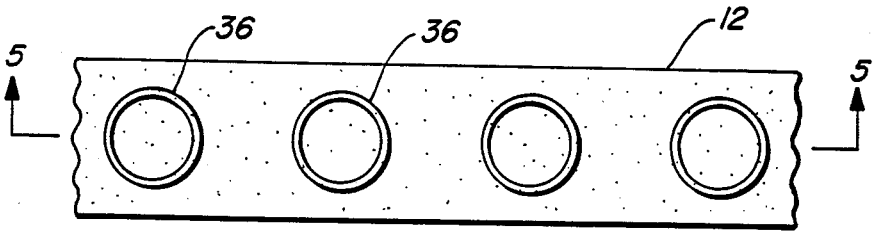
FIG. 4 is a top view of an alternate embodiment of the fluid support of the present invention.
Figure 5:
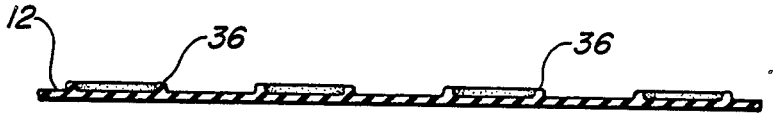
FIG. 5 is a sectional side veiw of the embodiment of FIG. 4.

Typically, fluid volumes of less than 100 microliters for conventional fluid samples and reagents utilized for analysis in clinical laboratories can be accommodated and can be supported on sheet 12 without the need for additional containment. The actual amount of fluid volume which can be supported without additional containment will depend on the area that can be conveniently wet by the fluid. The particular surface characteristics of both the fluid and the support surface will be factors. It is possible, however, that in certain applications it may be desirable to provide some mechanical means on sheet 12 to provide partial containment of the fluid sample at particular locations on the sheet. Continuous rib formations consisting of thickened portions 36 on sheet 12, as illustrated in FIGS. 4 and 5, can be utilized. Ribs 36 typically are not deformable and define enclosed surface areas on which the fluid sample can be deposited. The sheet material enclosed is made thin such that it can be deformed as described previously to form fluid receptacles. Thus, the fluid may be wholly contained on sheet 12 by surface tension or partially contained on sheet 12 by mechanical means or a combination of mechanical and non-mechanical means, but not wholly contained on sheet 12 by mechanical means. By the term "not wholly contained" is meant that the fluid is not totally enclosed by mechanical means such as a wall or walls. For example, in FIG. 4, the fluid is partially contained by sheet 12 and continuous rib 36 forming bottom and side walls; however there is no top wall to wholly contain the fluid.

When there is no separate containment means provided on sheet 12, it has been found, for example, that body fluids such as urine, blood and the like can be used in fluid volumes of between about 5–200 microliters. With typical fluids utilized in reagent testing and analysis, droplet sizes of between about 20 to 100 microliters are satisfactorily handled. Fluid volumes can be moved from one station or set of wells 20 to another by an appropriate support moving mechanism (not shown) where additional reactions or processing of the fluid volume can occur.

Support 12 can be provided as a strip, tape or sheet which is wound on a dispenser roll and taken up by a roll at the exit of the apparatus. Conventional mechanisms for driving the rolls can be employed. Additionally, control of such drive mechanisms using microprocessor units and techniques can be conveniently applied to provide automated systems. Upon completion of the operation being performed on the fluid sample, the fluid volumes can be moved through the system through a disposal station to remove the fluid from the sheet by suction or otherwise. If desired, that portion of the sheet which has been used can then be cut off and disposed of in an appropriate container for safe disposal.

Various types of elastomers to provide a flexible, liquid-impervious sheet 12 for the fluid support can be utilized. For example latex, silicone rubber, styrene butadiene, polyurethane and the like have been found useful. Rigid support 14 can be manufactured from conventionally suitable materials such as metals and plastics.

Wells 20 may be provided of varying sizes and it will be readily realized that a single fluid volume can be accommodated in wells of differing sizes. If the fluid support was a rigid container or the like, it would not be possible to automatically move the fluid containers across the support mechanism without individually or collectively removing the containers from the wells and then transferring them to new positions. Because sheet 12 is reversibly-deformable, relaxation of the deformation forces applied causes sheet 12 to resume substantially its original orientation, which permits sheet 12 and fluid droplets 16 to be moved to other locations.

While sheet 12 has been illustrated in combination with a separate support or substrate 18, that substrate structure could be formed directly into sheet 12 in the form of rolled edges, beads, ribs or thickened sections. Alternatively, sheet 12 can be utilized without any additional support whatsoever. However, the latter configuration may require a more complicated feeding mechanism in an automated setting because of the elastomeric nature of sheet 12.

Figure 3:
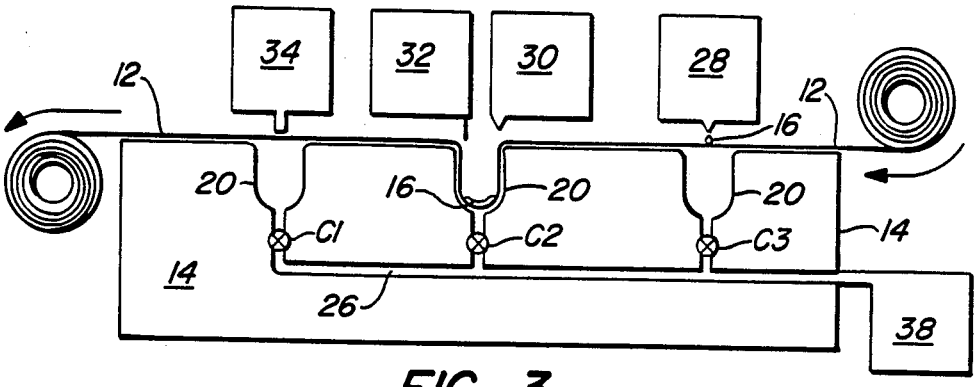
FIG. 3 is a schematic view of a fluid handling system for analysis in which the apparatus of this invention is utilized.

With reference to FIG. 3, a schematic diagram of a system utilizing the apparatus of the present invention is illustrated. The first support is conveniently provided as a tape 12 in a rolled configuration which is adapted to move across the surface of support 14 by an automatic, controlled moving mechanism (not shown). Support 14 defines a well 20. The system provides a fluid dispenser 28, a reagent dispenser 30, an analyzer 32 and a disposal unit 34. Those units are located at a position above the top surface of sheet 12. Additionally, a tape take-up means is provided to take up the used tape as it comes off the system. The tape or sheet can include indexing means coupled to the fluid dispenser 28 and reagent dispenser 30, individually or jointly, such that fluid and reagent dispensing is responsive to the position of the tape or sheet as indicated by the indexing means. A vacuum source 38 is provided and interconnected with well 20 through conduit 26 and controlled by means of C1, C2, and C3.

In a typical fashion, a fluid droplet is dispensed from fluid dispensing means 28 onto sheet 12. That droplet is then moved horizontally and linearly across the top of rigid support 14 to a location above well 20 where the vacuum source can be actuated. A reagent dispensing means 30 is provided to dispense reagent if required. Actuation of the vacuum source causes sheet 12 to spread into well 20 along the surface contours defined and form a container suitable for receipt of additional fluid. If appropriate, reagent is dispensed from dispenser 30 and the vacuum source pressure is modulated in order to promote mixing between the reagent and the sample volume. At that position or possibly at another position in the system if appropriate, analysis of the mixed fluid sample can take place by conventional analytical means 32. This may include, for example, sample removal from the well by pipetting or other suction mechanisms with analysis conducted at a remote site or direct analysis of the sample in the well by using appropriate detection probes and the like. After that analysis is completed the application of vacuum is removed and the flexible tape resumes its original configuration. Then the tape strip is moved along rigid support 14 to a position beneath disposal unit 34 which evacuates the fluid remaining on the flexible sheet. Thereafter the sheet is taken up and can either cut off, retained or dispensed in a safe manner. While separate fluid sample dispensing means, reagent dispensing means and fluid removal means have been described, those functions can be variously combined in conventional ways depending on the particular application. For example, a single pipetting mechanism could be utilized to dispense both fluid sample and reagent, as necessary, and also to evacuate the mixed fluid sample upon completion of the analytical test. Various modifications of this illustrative system will be apparent for particular applications and instrumentation, which can include a variety of particle or substance detection systems for the detection and/or measurement of materials in fluids.

One such application is in the medical diagnostic area for the detection and/or measurement of substances in human body fluids. For example, the invention may be utilized with an optical fiber probe and instrumentation to detect different signal intensities transmitted by the probe. The optical probe can consist of an input fiber and an output or detector fiber which are joined at a junction, typically by a Y-coupler. The optical fiber has a probe tip which can be extended into a fluid sample contained in the fluid receptacle formed in accordance with this invention. Fluorescent dyes or particles are conventionally added to the fluid sample such that the fluorescence of the sample produced upon irradiation by an incident beam of electromagnetic radiation transmitted through the optical probe will depend on the amount of analyte in the sample. The emitted signal from the fluid sample is transmitted through the tip of the probe into the detector fiber to produce an output signal which is picked up by a detector. The detector is a device capable of receiving photons and converting them to a form which permits differentiation between signals of different intensities. A photomultiplier is a typical example.

The volume from which the fluorescent light is obtained is determined by the construction of the optical fiber. The shape of the volume will normally be conical. The optical fibers are typically constructed of a core region and one cladding region, whose diameters and relative refractive indices determine both the half angle of the cone and the cone's smallest diameter (at the tip of the fiber). The effective axial length is determined by the intensity of the excitation beam and the rate of drop in intensity of the excitation light with increasing axial distance from the fiber tip. This rate depends upon the half angle of the cone (i.e. fiber acceptance angle), with larger half angles causing greater rates of intensity drop and hence shorter effective cone lengths. The effective axial length is also determined by the rate of drop of efficiency by which the fiber collects signals from sources further from the fiber. This rate also depends on the fiber acceptance angles. With larger angles the drop of collection efficiency begins at short axial distances. Also affecting the intensity drop will be light scattering and absorption properties of the medium.

Typical optical fibers employed will generally have a diameter of about 5 microns to about 500 microns, more usually from about 10 microns to 100 microns. The cone half angle of the effective sample volume will generally range from about 8° to about 60°, more usually from about 10° to about 30°. The effective length of the axis will also vary significantly generally ranging from about 0.5 to about 10 fiber diameters, more usually from about 1 to about 5 fiber diameters.

A particularly useful optical fiber device is the commercially available device known as a coupler, consisting of three optical fibers joined at a junction with three terminal ports, conveniently referred to as an input port (into which excitation light is fed), a probe port (which is submerged in the sample) and a detector port. In a form convenient for use in the present invention, the fibers are joined in such a manner that substantially all light entering the input port is transmitted to the probe port. Light entering the probe port (as from the fluorescent emission) may be split at the conduit juncture so that a portion will travel to the input port and a second portion to the detector port. Alternatively, a dichroic mirror can be utilized at the juncture directing substantially all of the fluorescent light to the detector port. Such devices are available from commercial suppliers, for example: Kaptron Incorporated, Palo Alto, Calif.

The excitation light may be provided by irradiating the entire sample or a major portion of the sample with excitation light. Alternatively and preferably the excitation light may be provided by the optical fiber, so that the sample volume observed will be proportional to the volume irradiated.

The subject invention can be utilized for determining an analyte in a sample, where the amount of analyte affects the total fluorescence or an observed pattern of fluorescence fluctuations. The analyte is a member of a specific binding pair consisting of ligand and its homologous receptor. The optical fiber is employed to receive fluorescent light from the sample volume. To observe fluorescence fluctuations one observes a plurality of such volumes, either by observing a single volume over an extended period of time, where particles move in and out of the volume, or scanning a plurality of volumes either simultaneously or successively, or combinations thereof. Thus, the percentage of volumes observed which have a predetermined difference in fluorescence from a defined level can be related to the amount of analyte in the medium.

The fluctuations in fluorescence can be achieved by various combinations of particles and continuous media. For example, the combinations can include particles which fluoresce at constant intensity in a non-fluorescing solution, particles which fluoresce at varying intensity in a non-fluorescing solution, particles which are non-fluorescent in a fluorescent solution and fluorescent particles in a fluorescent solution. Furthermore, the fluorescent fluctuation may be a result of aggregation of particles, non-fluorescent particles becoming fluorescent, or fluorescent particles becoming non-fluorescent. The particles may be comprised of polymers, both naturally occurring or synthetic, natural particles, such as virions and cells, e.g., blood cells and bacteria, or the like. Particle sizes will vary from 0.05 to 100μ, where synthetic particles will generally be from about 0.1μ to 10μ diameter.

The above-described apparatus and method can be employed in fluorescent assays with a large number of protocols and reagents. One group of protocols will involve measuring the total fluorescence from the liquid sample. Another will involve measuring fluorescent particles. This group can be further divided into particles which remain uniformly fluorescent, that is, there are basically two particle populations, fluorescent or non-fluorescent, where fluorescence above a certain level is defined as a positive or negative result. Another group includes protocols in which a fluorescing molecule is conjugated directly to an antibody (Ab), which then binds directly to a cell. See, for example, U.S. patent application Ser. No. 397,285, filed July 12, 1982 now U.S. Pat. No. 4,564,598.

In one approach, the particles may be uniformly fluorescent. As a result of binding of a quencher label to a particles, the particle becomes non-fluorescent. For example, fluorescent particles can be prepared having a ligand bound to the particles, which ligand is an analog of the analyte. Charcoal particles can be conjugated with anti-ligand (a receptor which specifically binds to a ligand). By combining in an assay medium, the sample containing the analyte, the ligand conjugated fluorescent particle and the anti-ligand conjugated charcoal particles, the number of charcoal particles which bind to the fluorescent particles over a predetermined time period will be determined by the amount of analyte in the medium. Thus, at time $t_1$ one examines a number of sample volumes and determines what percentage of these sample volumes results in the fluorescence being greater than the threshold value. After an interval of time, at time $t_2$, one repeats the same measurement. The rate of change in the percentage of sample volumes being greater than the threshold value will be related to the amount of analyte in the medium. This analysis has assumed that the binding of a charcoal particle to a fluorescent particle through the intermediacy of non-convalent binding of the ligand and the anti-ligand results in complete or substantially complete quenching of the fluorescent particles. Where only a small percentage of the total fluorescence is quenched by a charcoal particle, then the analysis will be basically the same as a heterogeneous population of particles having varying fluorescence.

A heterogenous population of fluorescent particles can come about in a number of ways. For example, one can have aggregation or agglutination of particles. The analyte could be a receptor or antibody, which is polyvalent in binding sites. Fluroescent particles could be conjugated with ligand, so that the polyvalent receptor would act as a bridge between particles. In this way, the greater the amount of analyte present in the medium. the larger the number of aggregates which will result. The particles of interest could then be chosen as a particle which is an aggregation of two or more or three or more particles. Furthermore, by appropriate electronic means, one could determine the size of the aggregation, counting not only the total number of particles, but the number of members of each population. As the aggregation increases in size, the fluorescence of the aggregate particle will also increase, but not linearly with the increase in the number of particles in the aggregation.

A second way for having a heterogeneous population has in part already been considered, where binding of quencher to a fluorescent particle only partially diminishes fluorescence. Alternatively, one could have a non-fluorescent particle, where fluorescent molecules become bound to the particle in proportion to the amount of analyte in the medium or to the number of binding sites on the particle. For example, one could have fluorescent molecules bound to an anti-ligand. Ligand could be bound to a non-fluorescent particle. The fluorescer conjugated anti-ligand would be combined with the analyte containing sample, so that the analyte could fill the binding sites of the anti-ligand, with the remaining binding sites being related to the amount of analyte in the sample. Upon addition of the ligand conjugated particles to the medium, the remaining fluorescent conjugated receptor would bind to the particles, providing for a distribution of particles of varying fluorescence.

Another technique may also be illustrated by employing an aggregation. In this technique, non-fluroresent particles are employed, and the continuous phase is made fluorescent. Thus, when the aggregation is present in the sample volume, there will be a substantial diminution in the observed fluorescence. These particles, while non-fluorescent should also be substantially opaque to excitation of fluorescent light. Thus, they will create a substantial shadow, inhibiting the detection of fluoresce in a volume substantially greater than the volume of the aggregation.

Still another way of obtaining a heterogeneous population of fluorescent particles is to allow a fluorescent tag to label non-fluorescent particles. For example, non-fluorescent particles may be cells which have a plurality of antigens on the cell surface, there being a number of each antigen present. By employing fluorescer-labeled-antibodies to specific surface antigens, a specific set of non-fluorescent cells will become fluorescent. The detection of the presence of such cells is a preferred method of cell identification, e.g. red blood cell (RBC) grouping and typing. For example, in the A, B, O system, if the fluorescent tag were conjugated to anti-A antibody, binding would occur and there would be a greater increase in cell fluorescence if the sample contained the A antigen of type A or type AB blood than if the analyte contained blood types B or O.

In addition to antibodies, certain lectins are known to bind in varying degrees to RBC surface antigens, and are convenient receptors for use in fluorometric assays.

Usually, there will be a distribution of levels of fluorescence, although in some situations it will be feasible to substantially saturate the available binding sites on the cell surface, so as to approximate only two populations, non-fluorescent cells and cells of substantially uniform fluorescence.

While not presently preferred, typing red blood cells (RBCs) or identifying red blood cell (RBC) antigens or the antibodies thereto can be effective by using the RBCs as fluorescence quenchers in an assay employing fluorescent particles to provide a detectable signal. Substances which bind to RBC antigens, normally antibodies or lectins (hereinafter "receptors") are conjugated to fluorescent particles. A solution of particle-conjugates is combined with red blood cells, e.g., whole blood, with an appropriate buffer. If an antigen is present on the RBCs that has a binding or determinate site specific for the receptor, the conjugated particles will bind to the RBCs which act as fluorescence quenchers.

Also, the determination of the presence of antibodies to a RBC antigen can be made. Three different techniques may be used. In one, fluorescently labeled antibodies compete with antibodies in the plasma or serum sample for antigen sites on test RBCs of a known group, with the observed cellular fluorescence decreasing with increasing amounts of antibodies against the specific antigen in the sample. Alternatively, the test RBCs may be fluorescently stained and, when combined with serum, the specific antibodies, if present, will agglutinate the fluorescent cells. In a third method, the fluorescent bead may be conjugated with the surface antigen of interest and antibodies present in the sample act as a bridge between RBCs of known type and the antigen conjugated fluorescent particles. In this situation, decreasing fluorescence would indicate the presence of the antibodies.

High extinction coefficients for the fluorescer are desirable and should be greatly in excess of 10,000 $cm^{-1}$ $M^{-1}$ and preferably in excess of 100,000 $cm^{-1}$ $M^{-1}$. The fluorescer should also have a high quantum yield, preferably between 0.3 and 1.0.

In addition, it is desirable that the fluorescer have a large Stokes shift, preferably greater than 20 nm, more preferably greater than 30 nm. That is, it is preferred that the fluorescer have a substantial spread or difference in wavelengths between the absorption and emission maxima.

One group of fluorescers having a number of the desirable properties are the xanthene dyes, which include the fluoresceins derived from 3,6-dihydroxy-9-phenylxanthhydrol and rosamines and rhodamines, derived from 3,6-diamino-9-phenylxanthene. The rhodamines and fluoresceins have a 9-O-carboxyphenyl group, and are derivatives of 9-O-carboxy-phenylxanthene.

These compounds are commercially available with or without substituents on the phenyl group.

Another group of fluorescent compounds are the naphthylamines, having an amino group in the alpha or beta position, usually alpha position. Included among the naphthylamino compounds are 1-dimethylaminonaphthyl-5-sulfonate, 1-anilino-8-naphthalene sulfonate and 2-p-toluidinyl-6-naphthalene sulfonate. Other fluorescers of interest include coumarins, e.g., umbelliferone, and rare earth chelates, e.g., Tb, Eu, etc. Descriptions of fluorescers can be found in Brand, et al., *Ann. Rev. Biochem.*, 41, 843–868 (1972) and Stryer, *Science*, 162, 526 (1968).

Appropriate particles are combined with the fluorescer using standard techniques to provide fluorescent beads or microspheres. Fluorescent particles are commercially available. The fluorescent beads may be varied widely as to size and composition. The beads will normally be made of an inert material and include a plurality of fluorescent chromophoric functionalities. The beads will have a sufficient concentration of fluorescent funtionalities to provide for a large signal per bead. Various organic polymers may be employed for the bead, e.g., polystyrene, polymethacrylate or the like or inorganic polymers, e.g., glass or combinations thereof. The particular choice of the polymeric composition is primarily one of convenience.

Conjugated to the fluorescent beads either covalently or non-covalently are receptors which may be antibodies, including monoclonal antibodies, or lectins, that bind either specifically or differentially to specific RBC surface antigens or antigens having the determinant site(s) of such RBC surface antigens or other antigens of interest.

The receptors are adsorbed to the fluorescent bead using standard techniques extensively described in the literature, which need not be repeated here. Alternatively, the receptors may be covalently bound by conventional techniques.

In one example of an assay, an RBC sample in a buffered aqueous solution comprising from 1-50% RBCs by volume is mixed with an approximately equal volume of the conjugated fluorescent receptor solution. As a control, an identical volume of fluorescent-Ab solution may be mixed with an equal volume of RBCs that lack specificity to the Ab. The mixed solutions are allowed to stand for up to 120 min. preferably 1-10 minutes at mild temperatures from above 0° C. to about 37° C., preferably about 15°-25° C. Other controls may be used. Free antigen or antibody could be added as an example, or the result could be compared with standard preparations of Type A, B or O blood or serum.

The foregoing invention has been described with particular reference to the drawings. However, while the invention has been described with respect to the specific embodiments thereof, it should be understood by those skilled in the art that various changes can be made in equivalence substituted without departing from the true spirit and scope of the invention. All such modifications are intended to be within the scope of the claims appended hereto.

What is claimed is:

1. A method of reducing parameter gradients throughout a fluid volume which comprises:

placing said fluid volume on a portion of a reversibly-deformable, substantially planar support sheet, optionally formed with non-deformable means thereon to partially contain said fluid volume, said support sheet being the sole containment means for said fluid volume; and deforming said reversibly-deformable portion of said support sheet.

2. The method of claim 1 wherein said deformation is effected by applying and removing a deformation force to said support at least once.

3. The method of claim 2 wherein said deformation force is applied and removed a plurality of times.

4. The method of claim 1 wherein said deformation is effected by the application of a deformation force to said support and the magnitude of said deformation force is caused to vary during its application.

5. The method of claim 1 wherein said support is deformed to form partial containment means for said fluid volume.

6. The method of claim 5 wherein said support is deformed by applying a pressure differential across said support.

7. The method of claim 6 wherein said pressure differential is created by the application of at least a partial vacuum.

8. The method of claim 1 wherein said support is maintained substantially planar and the deformation of said support occurs perpendicular to the plane of said support.

9. An apparatus for mixing a fluid which comprises:

a reversibly-deformable first support for receiving a fluid sample;

means for dispensing a portion of said fluid onto said first support;

a rigid second support located beneath a portion of said first support for supporting said first support portion at a first location; and means for applying a force to deform said first support and effect mixing of said fluid portion on said first support.

10. The apparatus of claim 9 wherein said second support is adapted to support said first support portion at a second location different than said first location.

11. The apparatus of claim 9 wherein said force application means are at least partially included within said second support.

12. The apparatus of claim 9 including means for moving said first support substantially horizontally over at least a portion of said second support.

13. The apparatus of claim 9 wherein said first support is formed from an elastomeric sheet.

14. The apparatus of claim 13 wherein said first support incldues a semi-rigid third support adapted to support a portion of said elastomeric sheet.

15. The apparatus of claim 14 wherein said first support is a continuous elastomeric sheet and said third support has discrete openings thereon.

16. A fluid handling apparatus comprising:

a liquid-impervious, reversibly-deformable flexible sheet having a first contour;

a substantially rigid support for said sheet; said support defining at least one well adjacent said sheet and having a second contour, and means for deforming said sheet to conform to said second contour and for releasing said sheet to conform to said first contour.

17. The apparatus of claim 16 including means for moving said sheet relative to said support.

18. The apparatus of claim 16 wherein said conforming means is operable to conform and release said sheet a plurality of times.

19. The apparatus of claim 16 wherein said rigid support defines a plurality of wells adjacent said sheet.

20. The apparatus of claim 19 wherein at least two of said plurality of wells have different volumes.

21. A support for a selected fluid volume which comprises a reversibly-deformable flexible, elastomeric sheet having surface characteristics operable to maintain said selected fluid volume without mechanical means of containment at a specific location on a portion of said sheet when said portion is substantially, horizontally planar, said sheet being of sufficient thickness to deform upon application of an external force, to form partial containment means for said fluid volume, and to return to said substantially, horizontally planar configuration when application of said force ceases.

22. The support of claim 21 which includes a first rotatable means for dispensing said sheet.

23. The support of claim 22 which includes a second rotatable means for receiving said sheet.

24. An apparatus for determining the presence of an element in a fluid sample suspected of containing said element, said apparatus comprising:

a liquid-impervious, flexible sheet;

a substantially rigid support for said sheet, said support defining at least one well adjacent to said sheet and having a selected contour;

means associated with said rigid support for reversibly conforming said sheet to said selected contour;

fluid dispensing means positioned to dispense a fluid sample onto said sheet; and means to detect the presence of said element within said sample.

25. The apparatus of claim 24 including means for dispensing a reagent into said fluid sample to enhance the detection of said element.

26. The apparatus of claim 25 wherein said reagent is a fluorescer.

27. The apparatus of claim 25 wherein said detection means includes an optical probe.

28. A method of mixing a fluid which comprises:

depositing a portion of a fluid volume on a substantially flat, liquid-impervious, reversibly-deformable support without additional mechanical means of fluid containment; and applying and releasing a deformation force perpendicular to said support sufficient to cause agitation and mixing of said deposited fluid portion without rupturing said support.

29. A method of mixing a fluid which comprises:

positioning a reversibly-deformable support without additional mechanical means of fluid containment to receive a portion of the fluid to be mixed;

depositing said portion of said fluid on said support to define a first interfacial area between said fluid portion and said support; and deforming said support to define a second interfacial area between said fluid portion and said support which is different than said first interfacial area.

30. A method of mixing a fluid which comprises:

locating a reversibly-deformable support having a fluid volume support thereon without additional mechanical means of fluid containment at a site adapted to effect deformation of said support; and applying a deformation force to said support at said site.

* * * * *